US007552720B2

(12) United States Patent
Borg et al.

(10) Patent No.: US 7,552,720 B2
(45) Date of Patent: Jun. 30, 2009

(54) FUEL PUMP CONTROL FOR A DIRECT INJECTION INTERNAL COMBUSTION ENGINE

(75) Inventors: Jonathan Borg, Erding (DE); Harsha Badarinarayan, Novi, MI (US); Donald J. McCune, Farmington Hills, MI (US); Atsushi Watanabe, Novi, MI (US); Takuya Shiraishi, West Bloomfield, MI (US); George Saikalis, West Bloomfield, MI (US)

(73) Assignee: Hitachi, Ltd, Tokyo (JP)

( * ) Notice: Subject to any disclaimer, the term of this patent is extended or adjusted under 35 U.S.C. 154(b) by 0 days.

(21) Appl. No.: 11/943,087

(22) Filed: Nov. 20, 2007

(65) Prior Publication Data

US 2009/0126688 A1 May 21, 2009

(51) Int. Cl.
*F02M 37/04* (2006.01)
*F02M 37/06* (2006.01)

(52) U.S. Cl. ..... 123/508; 123/506

(58) Field of Classification Search ..... 123/446, 123/508, 506, 507, 495, 496; 417/218, 221, 417/222.1, 307, 308
See application file for complete search history.

(56) References Cited

U.S. PATENT DOCUMENTS 4,643,155 A * 2/1987 O'Neill ..... 123/506
5,277,156 A * 1/1994 Osuka et al. ..... 123/198 DB
5,558,066 A 9/1996 Zhao
6,178,951 B1 1/2001 Doreau et al.
6,318,343 B1 * 11/2001 Nakagawa et al. ..... 123/500
6,336,445 B1 * 1/2002 Yamazaki et al. ..... 123/506
6,390,072 B1 5/2002 Breeden
6,526,947 B2 3/2003 Shimada et al.
6,694,952 B1 * 2/2004 Yamazaki et al. ..... 123/496
6,763,808 B2 7/2004 Ryuzaki et al.
7,198,033 B2 * 4/2007 Inaguma et al. ..... 123/506
2002/0040704 A1 * 4/2002 Onishi et al. ..... 123/446
2002/0129793 A1 * 9/2002 Tokuo et al. ..... 123/457
2003/0056758 A1 * 3/2003 Onishi et al. ..... 123/446
2006/0243253 A1 * 11/2006 Knight ..... 123/447

* cited by examiner

*Primary Examiner*—Mahmoud Gimie
(74) *Attorney, Agent, or Firm*—Gifford, Krass, Sprinkle, Anderson & Citkowski, P.C.

(57) ABSTRACT

A fuel pump for a direct injection internal combustion engine having a body with a valve seat. The valve includes a valve head and the valve is movably mounted to the body between an open position and a closed position. In its open position, the valve head is spaced from the valve seat white in its closed position, the valve head abuts against the valve seat and closes the valve. An electric coil upon energization moves the valve to an open position and, conversely, upon deenergization allows the valve to move to a closed position. A control circuit controls the energization of the coil to reduce the pump noise during operation of the engine, especially at low speeds.

12 Claims, 5 Drawing Sheets

FUEL PUMP CONTROL FOR A DIRECT INJECTION INTERNAL COMBUSTION ENGINE

BACKGROUND OF THE INVENTION

I. Field of the Invention

The present invention relates to the control of a fuel pump for a direct injection gasoline internal combustion engine.

II. Description of Material Art

Direct injection internal combustion engines, i.e. engines in which the fuel injector injects the fuel directly into the combustion chamber, exhibit several advantages over the more conventional port-fuel injected internal combustion chambers. Most notably, direct injection engines enjoy increased fuel economy over other types of internal combustion engines. Direct injection internal combustion engines, however, do exhibit some inherent disadvantages.

One disadvantage of the previously known direct injection internal combustion engines is that such engines exhibit excessive noise, which is particularly evident at low engine speeds. Such noise is attributable to noise from the fuel system.

A primary source of noise, especially at low speeds, for a direct injection engine arises from the fuel pump for the engine. Typically, a pump piston in a fuel pump is reciprocally driven by a cam having two or more typically three or four lobes. These lobes are all symmetrical and all contact the piston pump, usually through a roller. Upon rotation of the cam, the lobes cause the piston to move reciprocally within the pump housing.

The fuel pump also includes an inlet valve which is movable between an open position and a closed position by an electric coil or solenoid. In its open position, fuel flows to or from a pump chamber within the pump housing through the valve port. Conversely, when the valve is moved to its closed position, the piston during a pump cycle pumps pressurized fuel through a check valve and into the fuel rail for the engine.

The operation of the fuel pumps, however, causes significant noise, especially at low speeds, such as idle. A primary source of this noise is caused by the opening and closing of the valve.

More specifically, when the valve is moved to its open position by the electric coil or solenoid, the valve contacts a valve stop and produces an audible tick. Conversely, whenever the valve slams to a closed position during a pumping or pressurization portion of the pumping cycle, the contact between the valve head and the valve seat also causes audible noise. This noise is particularly prevalent at low speeds.

The rapid closure of the fuel valve is required for proper engine operation at high speed operation of the engine since the fuel pump operates at or near 100% of its capacity. However, such rapid closure of the fuel valve is not required at lower speeds, such as idle, due to the lower fuel requirements of the engine.

SUMMARY OF THE PRESENT INVENTION

The present invention provides a number of strategies for the fuel pump in a direct injection internal combustion engine which overcomes the above-mentioned disadvantages of the previously known fuel pumps.

Like the previously known fuel pumps, the fuel pump of the present invention includes a piston which is reciprocally mounted within a pump chamber formed in a pump housing. A valve is mounted within the pump housing and includes a fuel port that is open to the pump chamber as well as the fuel tank. This fuel valve is movable between an open and a closed position by an electric coil or solenoid.

With the valve in either a fully or partially open position, i.e. with the valve head spaced from the valve seat, reciprocation of the pump piston within the pump chamber during the suction portion of the pumping cycle inducts fuel from the fuel tank through the fuel port and into the fuel chamber. If the fuel valve is opened during a portion of the pressurization cycle for the pump, the pump piston pumps fuel from the pump chamber through the valve port and back to the fuel tank.

Conversely, if the valve is moved to a closed position by deenergization of the coil, the pump chamber is fluidly connected by a check valve to the fuel rails for the engine. Consequently, in this condition, the pump piston pressurizes the fuel rail in the desired fashion.

A control circuit controls the energization of the coil or solenoid to reduce the pump noise during the operation of the invention. In one form of the invention, the control circuit deenergizes the coil in a ramp function during valve closure whenever the engine speed is less than a predetermined threshold. This, in turn, minimizes the speed of impact of the valve head against the valve seat during closure, or impact of the valve against a mechanical stop during valve opening, and thereby reduces the pump noise.

In a second form of the invention, the control circuit maintains the energization of the coil, and thus maintains the valve in an open position, during a plurality of pressurization cycles of the pump during a low speed engine condition. Since the valve head does not impact the valve seat nor the valve impact the mechanical stop while the valve is held in an open position, noise from the fuel pump is reduced.

Alternatively, the control circuit actuates the valve to move the valve to an open position at the time that the valve is open a maximum amount by hydraulic pressure during the suction intake portion of the pump cycle. This also minimizes the speed of impact of the valve against the mechanical stop and thus reduces pump noise.

In still a further embodiment of the invention, the actuation of the coil or solenoid is controlled by a pulse width modulated current signal. During valve opening, the width of the first pulse to the coil is reduced as contrasted to subsequent current pulses to minimize the rate of opening of the valve at low engine speeds, and thus the rate of impact of the valve against the mechanical stop.

BRIEF DESCRIPTION OF THE DRAWING

A better understanding of the present invention will be had upon reference to the following detailed description when read in conjunction with the accompanying drawing, wherein lice reference characters refer to like parts throughout the several views, and in which.

DETAILED DESCRIPTION OF PREFERRED EMBODIMENTS OF THE PRESENT INVENTION

Figure 1:
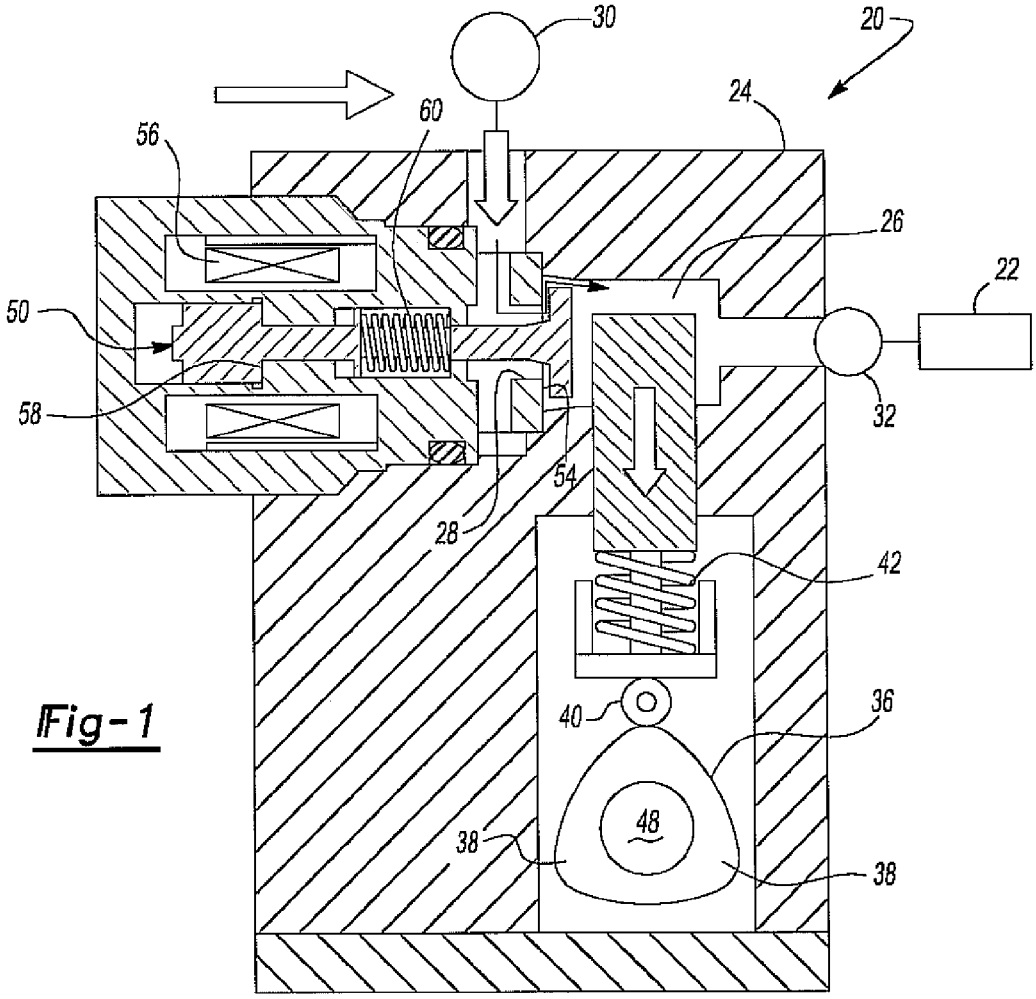
FIG. 1 is a sectional view illustrating the operation of a fuel pump according to the present invention during the suction portion of the pump cycle.
Figure 2:
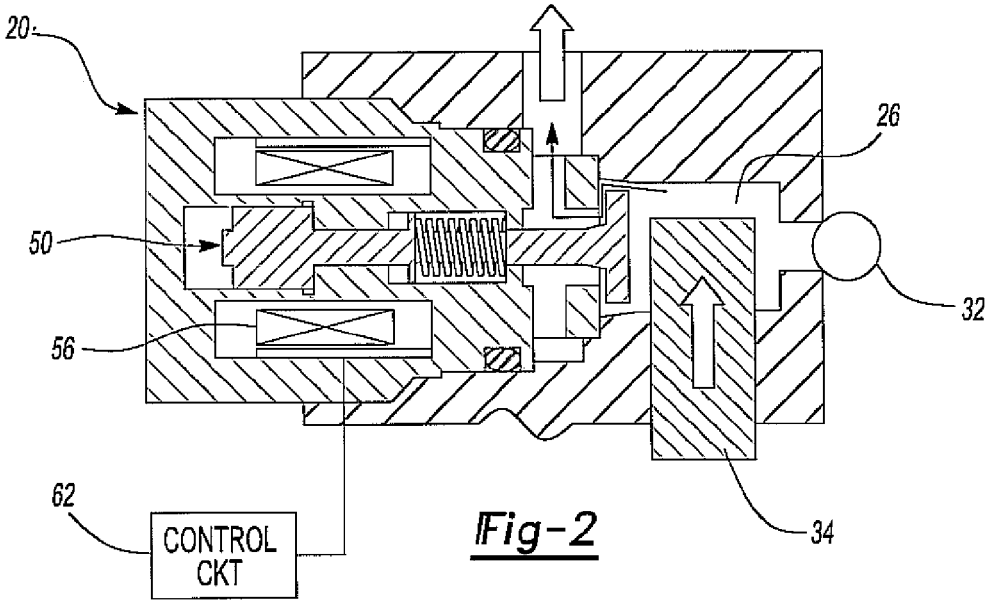
FIG. 2 is a view similar to FIG. 1, but illustrating the fuel pump during the initial portion of the compression cycle.
Figure 3:
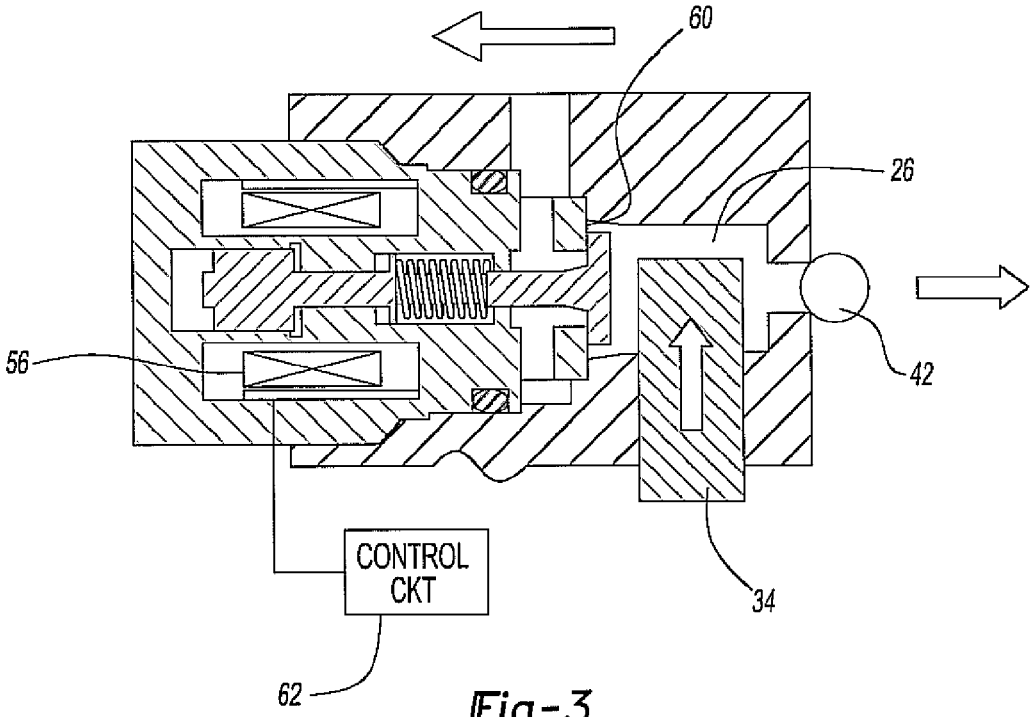
FIG. 3 is a view similar to FIGS. 1 and 2, but illustrating the fuel pump in the pumping portion of the pumping cycle.

With reference first to FIGS. 1-3, a pump 20 for a direct injection engine 22 is illustrated. The pump 20 includes a pump housing 24 which defines a pump chamber 26. The pump chamber 26 is fluidly connected through a valve port 28 to a fuel tank 30. The pump chamber 26 is also fluidly connected to the fuel rail for the engine 22 through a check valve 32.

A pump piston 34 is reciprocally mounted within the pump chamber 26. This pump piston 34 is reciprocally driven by a cam 36 typically having Three or more lobes 38. The cam 36 is mechanically coupled to the piston 34 by a roller 40 which follows an outer surface of the cam 36. This roller 40, furthermore, is maintained in contact with the cam 36 by a spring 42 so that as the engine 22 rotatably drives the cam 36, the cam 36 reciprocally displaces the piston 34 in the pump chamber 26.

The fuel pump 20 further includes a valve 50 having a valve head 52 which cooperates with a valve seat 54 which forms the valve port 28. An electric coil 56, upon energization, moves the valve 50 to an open position in which the valve head 52 is spaced from the valve seat 54 thus opening the port 28. When in its fully open position, furthermore, the valve 50 contacts a mechanical stop 58 which limits the extension of the valve 50 in its open position as shown in FIG. 1.

Conversely, upon deenergization of the coil 56, a spring 60 and hydraulic force returns the valve 50 to its closed position, illustrated in FIG. 3, in which the valve head 52 contacts the valve seat 54 and closes the fluid port 28.

A control circuit 62 controls the energization of the coil 56 to move the coil between its open position, illustrated in FIGS. 1 and 2, and its closed position, illustrated in FIG. 3. The operation of the control circuit 62 will be subsequently described in greater detail.

In operation, during the suction portion of the pumping cycle, i.e. when the cam 36 moves the pump piston 34 away from the pump chamber 26, the pump piston 34 inducts fuel from the fuel tank 30 through the fuel port 28 and into the pump chamber 26. During this suction portion of the pumping cycle, the hydraulic pressure caused by the fuel flow from the fuel tank 30 into the pump chamber 26 maintains the valve 50 in a partially open position.

At some point before the bottommost position of the pump piston 34, i.e. when the volume of the pump chamber 26 is at a maximum, the control circuit 62 energizes the coils 56 and moves the valve 50 to an open position. During low speed engine conditions, i.e. when the engine speed is less than a predetermined threshold, the control circuit 62 maintains the valve 50 in an open position during the initial portion of the pressurization cycle. During this time, the reciprocation of the pump piston 34 into the pump chamber 26 thus pumps fuel from the pump chamber 26, through the fuel port 28 and back to the fuel tank 30.

At some time prior to the top dead center position of the engine, i.e. where the pump piston 34 is extended to its maximum amount into the pump chamber 26, the control circuit 62 deenergizes the coils 56 thus causing the valve 50 to move to its closed position illustrated in FIG. 3. When this happens, the increasing pressure within the pump chamber 26 forces the check valve 32 to an open position and pumps the fuel from the pump chamber 26 to the fuel rail of the direct injection engine 22.

There are two primary sources of noise from the fuel pump during low speed engine operation. First, the energization of the coils 56 and the movement of the valve 50 to its open position causes the valve 50 to impact against its mechanical stop 58 and cause a ticking sound. Similarly, as the valve 70 is moved to its closed position, such as illustrated in FIG. 3, the impact of the valve head 52 against the valve seat 54 also causes noise which is audible at low engine operating conditions.

Figure 4:
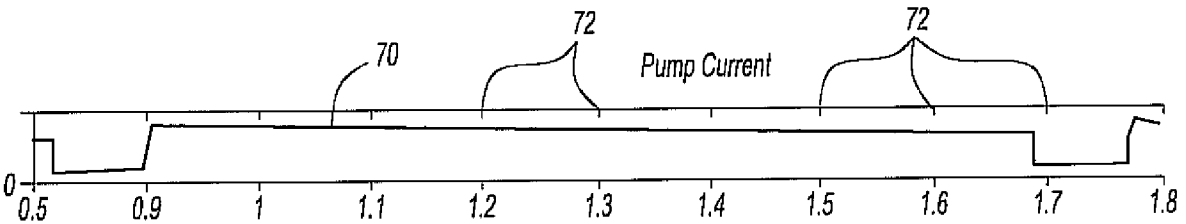
FIG. 4 is a graph illustrating the coil current versus time for a first embodiment of the invention.

With reference now to FIG. 4, during low engine speed conditions, i.e. when the engine speed is less than a predetermined threshold and the engine fuel requirements are relatively low, the engine control circuit 62 energizes the coil 56 and holds the valve 50 open over multiple pumping cycles 72, i.e. wherein each pumping cycle represents one complete reciprocation of the pump piston 34 in the pump housing 24. Thus, as shown in FIG. 4, a graph 70 of the pump current is illustrated through numerous pump cycles 72. Since the valve is moved to its open position only once over multiple pump cycles and thus causes contact between the valve 50 and its mechanical stop 58 only once over multiple cycles, the audible noise from such valve opening and closing (and pressurization) is reduced. Furthermore, even though the pump 20 provides less fuel pressure to the engine 22 since the valve 50 is held in its open position, such reduced fuel pumping capacity from the fuel pump 20 is acceptable due to the reduced fuel demands of the engine 22 at low speeds.

Figure 5:
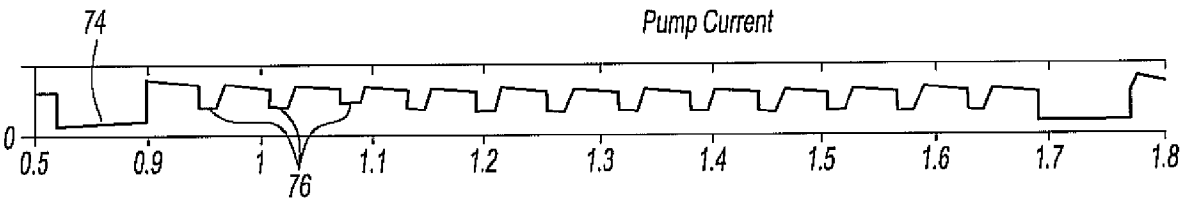
FIG. 5 is a view similar to FIG. 4, but illustrating a modification thereof.

With reference now to FIG. 5, holding the fuel valve 50 open by energizing the coil 56 over a plurality of pumping cycles may cause undesirable or unacceptable heating of the coil 56. To prevent such overheating the control circuit 62 reduces the current flow to the coil 56 during the suction portion of each pumping cycle. Thus, FIG. 5 illustrates a graph 74 of the current to the coils 56 and in which the current is reduced during the suction portion of each pumping cycle as shown at 76. The valve 50, however, remains fully opened during the suction portion of the pumping cycle due to the co-operating hydraulic pressure caused by the fuel inflow into the pumping chamber 26 during the suction portion of each pumping cycle.

Figure 6:
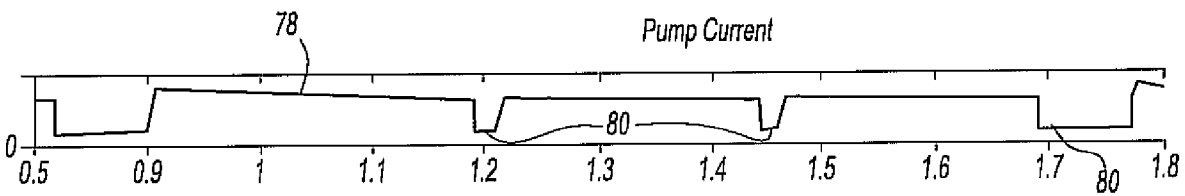
FIG. 6 is a view similar to FIGS. 4 and 5, but illustrating a further modification thereof.

With reference now to FIG. 6, a still further alternative is shown in which the control circuit 62 deenergizes the coil 56 after a certain maximum amount of time as shown at 80 in graph 78. Such deenergization of the coils is illustrated at 80 in FIG. 6 and such deenergization protects the coils 56 from overheating.

Figure 7:
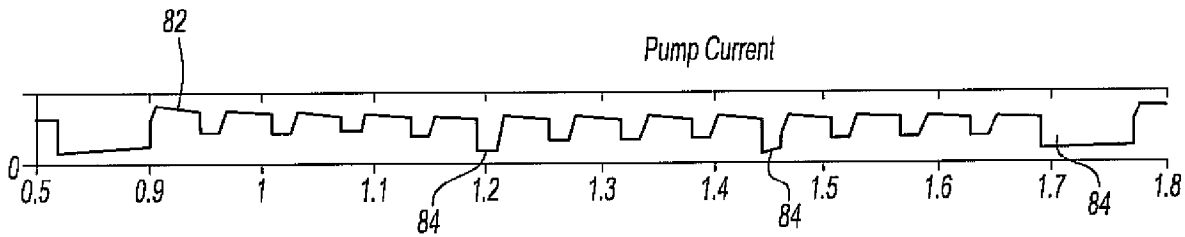
FIG. 7 is a view similar to FIGS. 4-6, but illustrating still a further modification thereof.

With reference now to FIG. 7, a still further modification is shown of the current control by the control circuit 62 for the coils 56. In FIG. 7, a graph 82 of the current flow for the coil 56 is shown in which the current flow is reduced during each suction portion of the pumping cycle in a fashion similar to FIG. 5. However, unlike FIG. 5, the control circuit 62 also deenergizes the coils 56 after a certain maximum time period in a fashion similar to that illustrated in FIG. 6. Consequently, although the graph 82 of current flow in FIG. 7 shows a reduction in the current flow during each suction portion of the pumping cycle, a larger reduction of the current flow, i.e. a current to zero, also occurs after each maximum time period as shown at 84.

Regardless of which of the strategies illustrated in FIGS. 4-7 is employed, the overall number of impacts between the valve 50 and its mechanical stop 58 or between the valve head 52 and the valve seat 54 is reduced thus reducing the overall noise from the fuel pump during low speed engine operating conditions.

Figure 8:
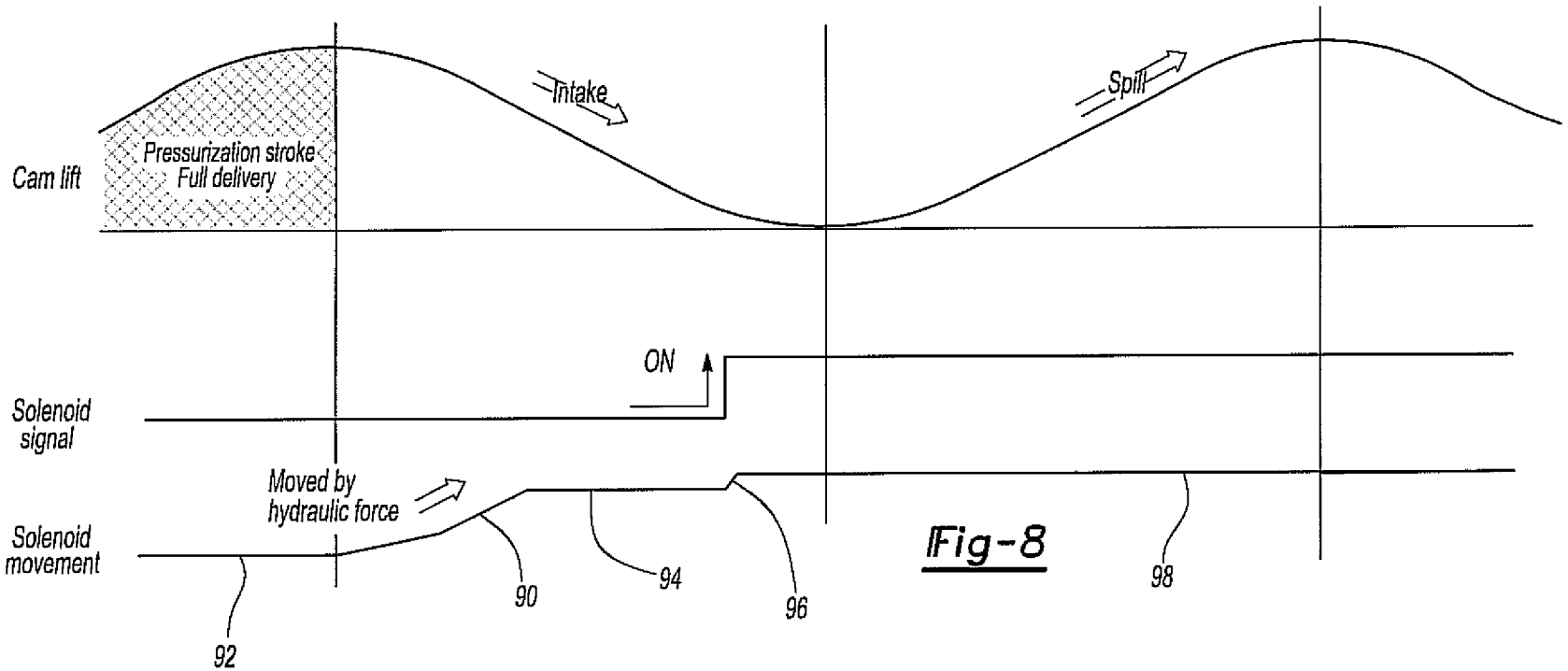
FIG. 8 is a graph illustrating yet a further embodiment of the present invention.

With reference now to FIG. 8, a still further strategy is illustrated for the control of the energization of the coil 56 by the control circuit 62. The movement of the valve is shown by graph 90 in which the valve 50 moves from a closed position, illustrated at position 92, to a partially open position, illustrated at 94, during the intake portion of the pump cycle. This partial opening of the valve 50 is caused by the hydraulic pressure of the incoming fuel flow to the pump chamber 26 during the suction cycle.

After the valve is opened to its maximum partially open position due to the hydraulic pressure, the control circuit 62 energizes the coils 56 at time 96 thus causing the valve 50 to move to its fully open position illustrated at 98. However, by timing the energization of the coils 56 to a period after the valve 50 is moved to its maximum partially open position due to hydraulic pressure at low engine speeds, the speed of impact of the valve 70 against its mechanical stop 58, and thus the noise from the fuel pump, is reduced.

Figure 9:
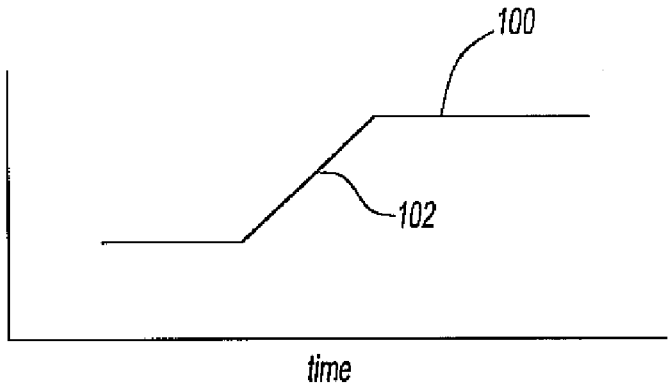
FIG. 9 is a graph of the coil current versus time for still a further embodiment of the invention.

With reference now to FIG. 9, a still further strategy to reduce fuel pump noise at low engine speed is illustrated as a graph 100 of the coil current as a function of time. As shown in FIG. 9, the control circuit 62 utilizes a ramp function 102 to energize the coil and move the valve 50 to its open position. The ramp 102 thus effectively reduces the speed of impact of the valve 50 against its mechanical stop 58 at low engine speeds and thus reduces the pump noise.

Figure 10:
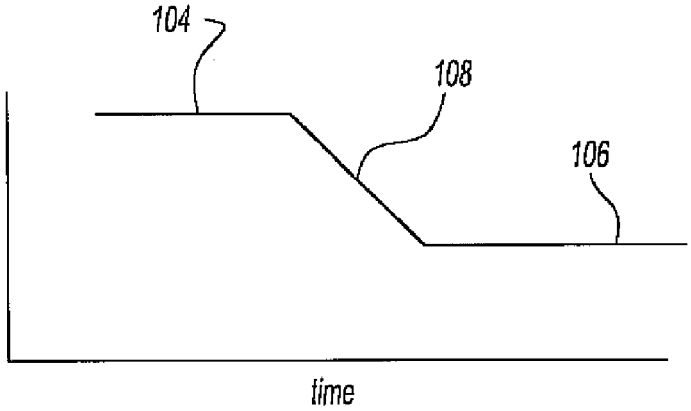
FIG. 10 is a view similar to FIG. 9, but illustrating yet another embodiment of the present invention.

Similarly, with reference to FIG. 10, the control circuit 62 also optionally deenergizes the coil 56 from its fully energized position, illustrated at 104, into a deenergized condition illustrated at 106 through a ramp function 108. Thus, by reducing the current to the coil 56 through the ramp function 108 during deenergization of the coil 56 at low engine speeds, the speed of impact of the valve head 52 against the valve seat 54 is reduced thus reducing pump noise.

Figure 11:
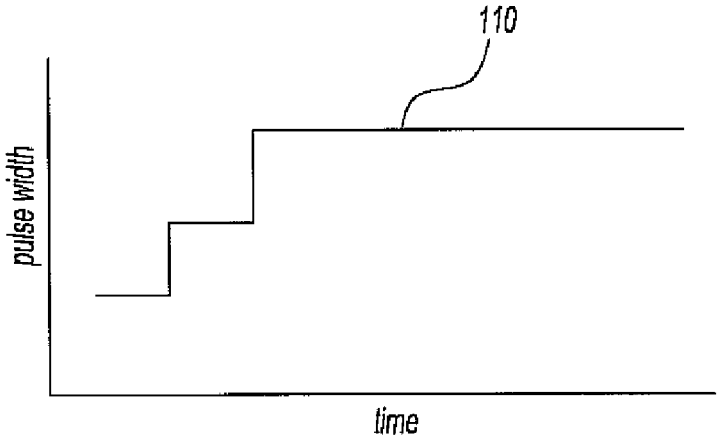
FIG. 11 is a view illustrating the pulse width versus time of the coil current for still a further embodiment of the present invention.

The control circuit preferably energizes the coil 56 through pulse width modulation of the current. Thus, with reference to FIG. 11, the speed of opening of the valve 50 at low engine speeds may be controlled by the control circuit 62 by reducing the pulse width of the current signal to the coil 56 during the initiation of the valve opening as shown in graph 110. By reducing the initial pulse width of the current to the coil 56, the control circuit 62 reduces the speed of impact, and thus the noise, of the valve 50 against its mechanical stop 58. Conversely, the pulse width can be progressively stepped down curing solenoid valve closing to reduce impact of valve head 52 against valve seat 54.

Figure 12:
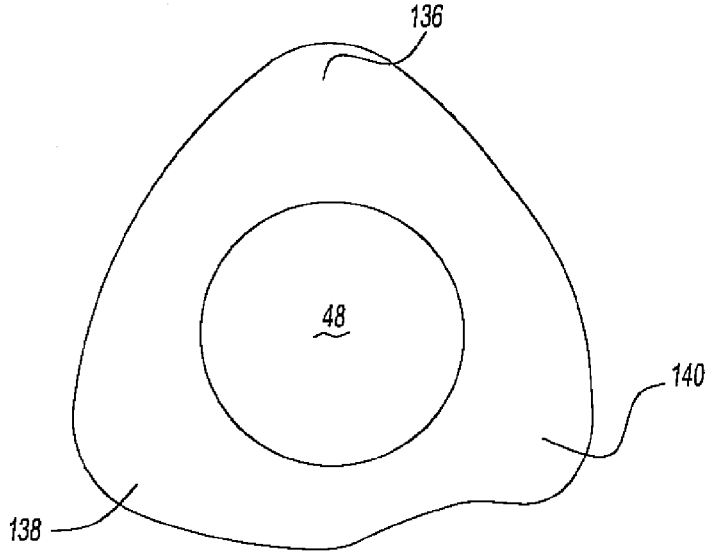
FIG. 12 is a plan view illustrating a modification to the invention.

With reference now to FIG. 12, the fuel noise from the fuel pump, especially fuel noise caused by the fuel suction, may be reduced by varying the lobe design for the pump. More specifically, as illustrated in FIGS. 12 and 13, the cam 36 of the fuel pump 20 includes three lobes 136, 138 and 140 which are angularly equidistantly spaced around the cam 134 and each of the lobes 136-140 are of the same angular length. Each lobe 136-140 reciprocates the pumping piston 34 through one complete pumping cycle.

Although the lobes 136 and 138 are symmetrical with each other, the lobe 140 is not symmetrical with the lobes 136 and 138. In practice, the asymmetry of the lobe 140 reduces pump noise caused by the pump suction. For the strategy where one pressurization stroke is followed by multiple redundant strokes, the lobe 140 provides a slower pressurization rate and hence lower pressurization noise.

From the foregoing it can be seen that the present invention provides a novel pump control for a direct injection internal combustion engine which reduces fuel noise of the type that is evident at low engine speeds. Having described our invention, however, many modifications thereto will become apparent to those skilled in the art to which it pertains without deviation from the spirit of the invention as defined by the scope of the appended claims.

We claim:

1. A fuel pump for a direct injection internal combustion engine comprising:

a body having a valve seat, a valve having a valve head, said valve movably mounted to said body between an open position in which said valve head is spaced from said valve seat, and a closed position in which said valve head abuts against said valve seat, an electric coil which, upon energization, moves said valve to said open position and, upon deenergization, allows said valve to move to said closed position, a control circuit which controls the energization of said coil to reduce the pump noise during operation of the engine, wherein said control circuit deenergizes said coil in a ramp function whenever the speed of the engine is less than a predetermined threshold to thereby reduce the speed of closure of said valve head from said open to said closed position.

2. The invention as defined in claim 1 wherein said control circuit maintains the coil energization through a plurality of pressurization cycles of the pump during predetermined engine operating conditions.

3. The invention as defined in claim 2 wherein said predetermined engine operating conditions include an engine idling condition.

4. The invention as defined in claim 1 wherein said control circuit maintains said coil energized for a predetermined time period during predetermined engine operating conditions.

5. The invention as defined in claim 4 wherein said predetermined engine operating conditions include an engine idling condition.

6. The invention as defined in claim 1 wherein said control circuit maintains the coil energization through a plurality of pressurization cycles of the pump up to a maximum time period during predetermined engine operating conditions.

7. The invention as defined in claim 1 wherein said control circuit reduces current to said coil during a pump suction intake portion of at least one pump cycle.

8. The invention as defined in claim 1 wherein said control circuit energizes said coil in a ramp function during a pump suction intake portion of at least one pump cycle to thereby reduce the speed of opening of said valve head to said open position.

9. The invention as defined in claim 1 wherein said coil is energized by a pulse width modulated control signal and wherein said control circuit reduces the current pulse width of the first current pulse during a valve opening cycle.

10. The invention as defined in claim 1 wherein said control circuit energizes said coil at a time when valve opening caused by hydraulic pressure during a fuel intake portion of each pump cycle is at a maximum.

11. The invention as defined in claim 1 wherein said coil is de-energized by a pulse width modulated control signal wherein said control circuit decreases the pulse width during said de-energization.

12. A fuel pump for a direct injection internal combustion engine comprising:

a body having a valve seat, a valve having a valve head, said valve movably mounted to said body between an open position in which said valve head is spaced from said valve seat, and a closed position in which said valve head abuts against said valve seat, an electric coil which, upon energization, moves said valve to said open position and, upon deenergization, allows said valve to move to said closed position, a control circuit which controls the energization of said coil to reduce the pump noise during operation of the engine, wherein said coil is de-energized by a pulse width modulated control signal wherein said control circuit decreases the pulse width during said de-energization.

* * * * *